US010598017B2

(12) United States Patent
Gerez et al.

(10) Patent No.: US 10,598,017 B2
(45) Date of Patent: Mar. 24, 2020

(54) METHOD OF IDENTIFYING THE BALANCING CONFIGURATION INSTALLED ON A TURBINE ENGINE ROTOR

(71) Applicant: SNECMA, Paris (FR)

(72) Inventors: Valerio Gerez, Moissy-Cramayel (FR); Francois Prost, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 662 days.

(21) Appl. No.: 15/111,414

(22) PCT Filed: Jan. 5, 2015

(86) PCT No.: PCT/FR2015/050007
§ 371 (c)(1),
(2) Date: Jul. 13, 2016

(87) PCT Pub. No.: WO2015/104488
PCT Pub. Date: Jul. 16, 2015

(65) Prior Publication Data

US 2016/0333695 A1 Nov. 17, 2016

(30) Foreign Application Priority Data

Jan. 13, 2014 (FR) ..... 14 50250

(51) Int. Cl.
*F01D 5/02* (2006.01)

(52) U.S. Cl.
CPC ..... *F01D 5/027* (2013.01); *F05D 2230/72* (2013.01); *F05D 2240/24* (2013.01); *F05D 2270/8041* (2013.01)

(58) Field of Classification Search
CPC .. F01D 5/027; F05D 2240/24; F05D 2230/72; F05D 2270/8041; F16F 15/32; F16F 15/322; F16F 15/34
See application file for complete search history.

(56) References Cited

U.S. PATENT DOCUMENTS 7,303,377 B2 * 12/2007 Rockarts ..... F01D 5/027 416/144
7,412,898 B1 * 8/2008 Smith ..... G01L 5/24 73/761

(Continued)

FOREIGN PATENT DOCUMENTS

EP 2253800 A2 * 11/2010 ..... F01D 5/027
FR 2 939 470 A1 6/2010

OTHER PUBLICATIONS

International Search Report dated Apr. 23, 2015 for PCT/FR2015/050007 filed on Jan. 5, 2015.

(Continued)

*Primary Examiner* — Brian P Wolcott
(74) *Attorney, Agent, or Firm* — Oblon, McClelland, Maier & Neustadt, L.L.P.

(57) ABSTRACT

A method of identifying the balancing configuration installed on a turbine engine rotor using a plurality of screws forming balance weights that are mounted on the rotor at different angular positions of the rotor is provided. Each screw possesses a predetermined weight and each screw is associated with an element for identifying its weight and for identifying its angular position on the rotor. The method includes contactless scanning of all of the screws mounted on the rotor by an identification appliance capable of recognizing the elements for identifying the weight and the angular position associated with each screw.

12 Claims, 2 Drawing Sheets

(56) References Cited

U.S. PATENT DOCUMENTS

| | | | | |
|---|---|---|---|---|
| 7,656,445 | B2 * | 2/2010 | Heyworth | G01B 11/16 348/265 |
| 7,957,851 | B2 * | 6/2011 | Braswell | F01D 5/027 416/219 R |
| 8,215,910 | B2 * | 7/2012 | Belmonte | B64C 11/14 416/144 |
| 8,434,216 | B2 * | 5/2013 | Mall | F01D 5/027 29/402.03 |
| 8,985,952 | B2 * | 3/2015 | Belmonte | F01D 5/027 416/144 |
| 9,016,560 | B2 * | 4/2015 | Kotian | F01D 21/003 235/375 |
| 9,182,311 | B2 * | 11/2015 | Clark | F01D 5/027 |
| 9,279,338 | B2 * | 3/2016 | Quiroz-Hernandez | B64C 11/008 |
| 9,970,298 | B2 * | 5/2018 | Le Strat | F01D 5/027 |
| 10,030,534 | B2 * | 7/2018 | Roberts | F01D 17/02 |
| 2007/0110543 | A1 * | 5/2007 | Fitch | F16B 1/0071 411/386 |
| 2010/0260605 | A1 * | 10/2010 | MacFarlane | F01D 5/027 416/144 |
| 2011/0223008 | A1 | 9/2011 | Belmonte et al. | |
| 2015/0315914 | A1 * | 11/2015 | Nicq | F16F 15/32 416/144 |

OTHER PUBLICATIONS

French Search Report dated Sep. 19, 2014 for FR 1450250 filed on Jan. 13, 2014.

* cited by examiner

METHOD OF IDENTIFYING THE BALANCING CONFIGURATION INSTALLED ON A TURBINE ENGINE ROTOR

BACKGROUND OF THE INVENTION

The present invention relates to the general field of balancing a turbine engine rotor, and in particular a fan of an airplane turbojet.

In known manner, a turbojet has a fan feeding air to a primary flow channel including in particular a low-pressure compressor, a high-pressure compressor, a combustion chamber, a high-pressure turbine, and a low-pressure turbine.

At its upstream end, the turbojet has an air inlet for feeding the fan. This inlet comprises in particular a disk having blades mounted thereon that are circumferentially spaced apart from one another. An inlet cone is fastened on the fan disk in order to deflect the air admitted into the turbojet towards the fan blades.

In order to compensate any unbalance that might affect the rotating fan while the turbojet is in operation, and thus in order to reduce engine vibration, it is known to balance the fan by using screws that form balance weights that are engaged in the disk or in the inlet cone. More precisely, these screws are of mutually different lengths so as to give them different weights. The number, the positions around the axis of rotation of the fan, and the lengths of these screws define a balancing configuration for the fan on which they are installed.

Likewise, in order to compensate the unbalance affecting the low-pressure turbine in rotation during operation of the turbojet, clips are mounted on the free ends of the blades of the last stage of this turbine. The numbers and the positions of these clips define a balancing configuration of the low-pressure turbine, which is installed thereon.

When calculating a new balancing solution, it is important for the balancing configurations for the fan and for the low-pressure turbine that have actually been installed to be known. For this purpose, the balancing configurations are stored in the electronic computer of the engine (also known as an engine monitoring unit (EMU)). Calculating a new balancing configuration thus implies that the EMU has stored in its memory the configurations of the screws installed on the fan and of the clips mounted on the last stage of the low-pressure turbine. Unfortunately, in the event of the EMU being replaced, the balancing programs stored in memory are lost and it is necessary to reinitialize the memory of the new EMU with the configurations of the screws actually installed on the fan and of the clips mounted on the last stage of the low-pressure turbine.

In order to discover the configuration of these screws installed on the fan, it is therefore necessary to unscrew each screw, to observe its length in order to know its weight, and then to screw it back on. Likewise, in order to discover the configuration of the clips mounted on the blades of the last stage of the low-pressure turbine, it is necessary either to partially dismantle the rear end of the engine, or else to use a special tool for accessing this stage together with appropriate viewing means. These inspection operations are laborious and they require qualifications that the technician in charge of reinitializing the memory of the EMU need not necessarily possess.

In order to mitigate such drawbacks, French patent application No. 12/61830 filed on Dec. 10, 2012 by the Applicant proposes that each screw forming a balance weight presents a screw head with a particular visual characteristic that is associated with its weight (e.g. a particular shape or color) and that can be detected directly by the naked eye (the screw heads do not all match). Thus, during an operation of reinitializing the memory of the EMU of the engine, the balance weights that are mounted on the rotor, e.g. on the fan of the turbine engine, are identified merely by looking at the screw heads and comparing their characteristics with a pre-established table.

Nevertheless, with such a solution, human errors are possible while identifying the various visual characteristics of the screw heads and their angular positions on the rotor, so there a risk that the balancing configuration installed on the rotor is not correctly identified.

OBJECT AND SUMMARY OF THE INVENTION

A main object of the present invention is thus to provide a method of identifying the balancing configuration installed on a turbine engine rotor that does not present the above-mentioned drawbacks.

In accordance with the invention, this object is achieved by a method of identifying the balancing configuration installed on a turbine engine rotor by means of a plurality of screws forming balance weights that are mounted on the rotor at different angular positions of the rotor, each screw possessing a predetermined weight and each screw being associated with an element for identifying its weight and for identifying its angular position on the rotor, the method comprising contactless scanning of all of the screws mounted on the rotor by means of an identification appliance capable of recognizing the elements for identifying the weight and the angular position associated with each screw.

The method of the invention is remarkable in that the elements identifying the weights and the angular positions on the rotor of the balance weights are read not by a human but by means of an identification appliance that operates without making contact. As a result, human error is no longer possible while reading the balancing configuration. Furthermore, the identification method can be automated, thereby making it possible to have no need for an operator, and also making it possible to ensure that the balancing configuration of the rotor is identified systematically.

In an implementation, the screws mounted on the rotor are scanned by a digital camera associated with image processing software.

In this implementation, each screw is mounted in a hole of the rotor that presents an element visually identifying its angular position on the rotor, and each screw has a screw head having a visual characteristic previously associated with its weight. The element visually identifying the angular position on the rotor of each screw may be a visual mark, in particular a number, applied in the vicinity of each hole in the rotor and previously associated with a determined angular position on the rotor, and the visual characteristics of the screw heads may consist in particular shapes and/or colors.

In another implementation, the screws mounted on the rotor are scanned by a radio frequency identity (RFID) tag reader associated with data processing software.

In this implementation, each screw is mounted in a hole of the rotor by means of a nut, each screw having an RFID tag with an electronic chip containing an element for identifying the weight of the screw, and each nut having an RFID tag with an electronic chip containing an element identifying the angular position of the screw on the rotor.

Furthermore, the method may include a prior step consisting in establishing a table listing each of the elements for identifying the weight and the angular position of a screw.

Finally, the method may further include automatically storing and transmitting the identified balancing configuration to an avionics system.

BRIEF DESCRIPTION OF THE DRAWINGS

Other characteristics and advantages of the present invention appear from the following description made with reference to the accompanying drawings, which show implementations having no limiting character. In the figures.

DETAILED DESCRIPTION OF THE INVENTION

Figure 1:
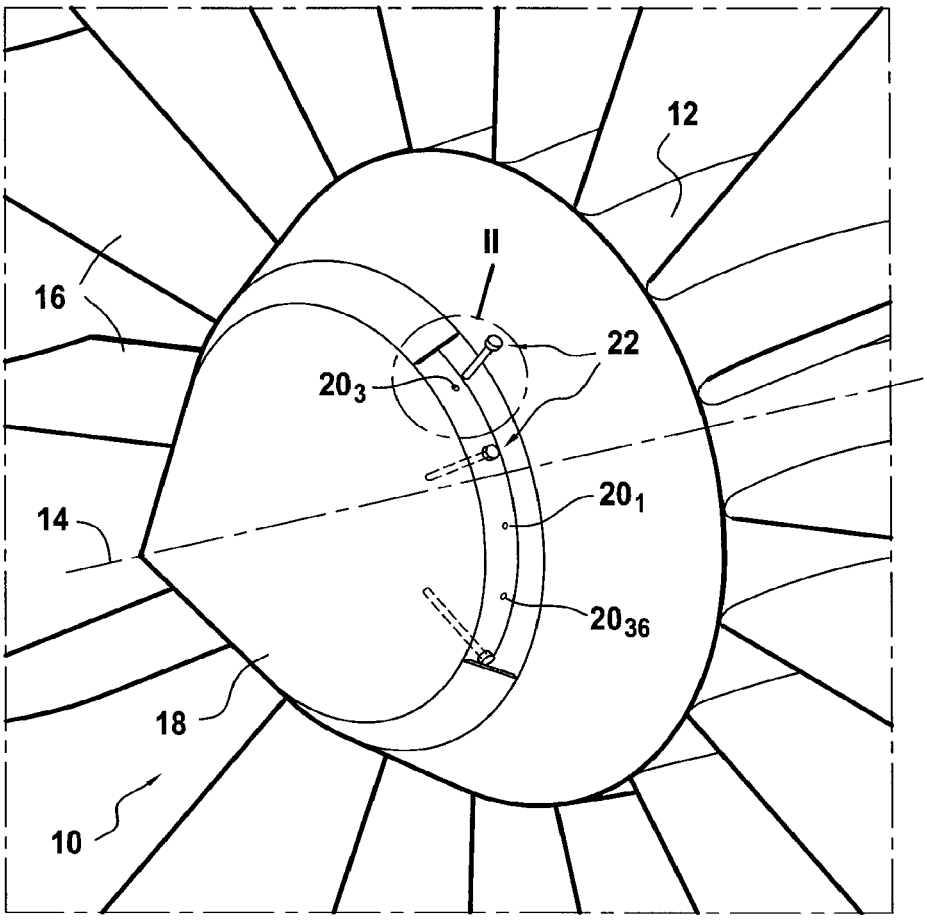
FIGS. 1 to 3 are diagrammatic views of a turbojet fan presenting a balancing configuration to which the identification method of the invention applies.
Figure 2:
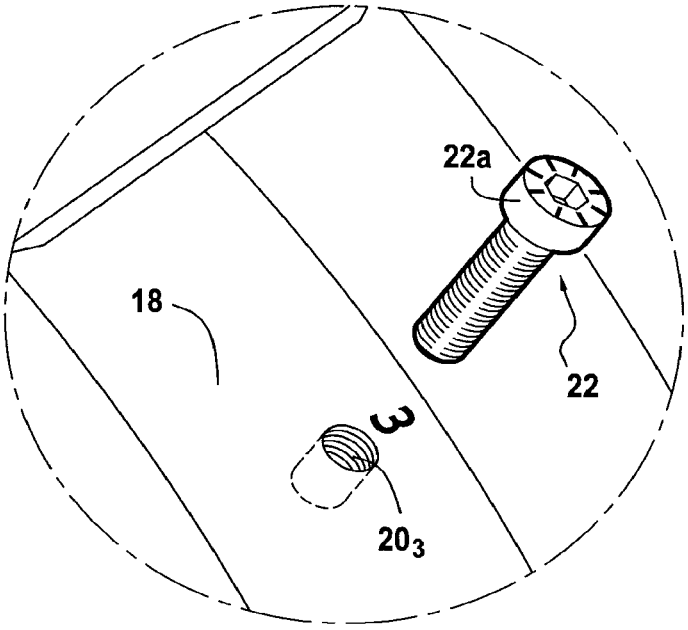
Figure 3:
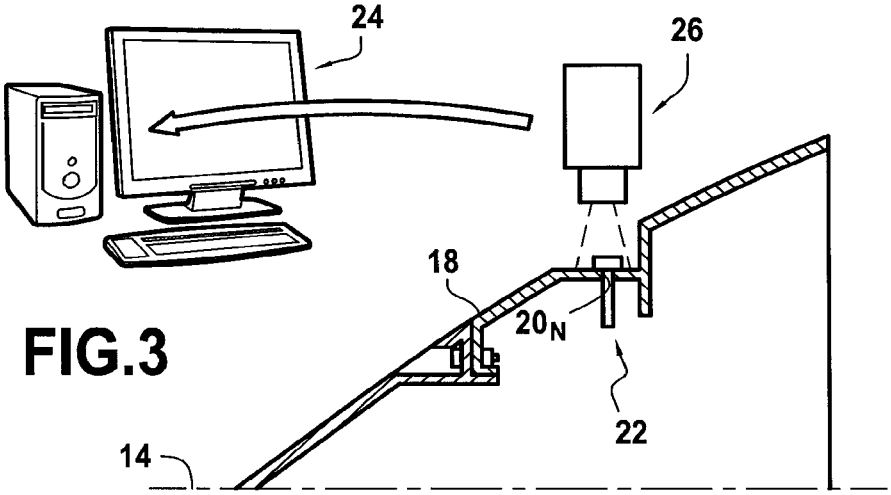

The invention applies to any turbine engine rotor, and in particular to a turbojet fan as shown highly diagrammatically in FIGS. 1 to 3.

In known manner, the fan 10 of a turbojet comprises in particular a disk 12 centered on an axis of rotation 14 and having mounted thereon blades 16 that are circumferentially spaced apart from one another. An air inlet cone 18 is fastened on the disk 12 upstream therefrom in order to deflect the air admitted into the turbojet towards the fan blades 16.

The fan 10 also has a plurality of holes $\mathbf{20}_1$ to $\mathbf{20}_N$ (e.g. 36 holes) that are regularly spaced apart around its axis of rotation 14. By way of example, these holes $\mathbf{20}_1$ to $\mathbf{20}_N$ are formed in the outer periphery of the air inlet cone 18. Alternatively, they could be made directly in the disk 12 of the fan.

In the implementation of FIGS. 1 to 3, these holes $\mathbf{20}_1$ to $\mathbf{20}_N$ extend in a radial direction, and each of them presents a right section of circular shape and with the same diameter.

At least some of the holes $\mathbf{20}_1$ to $\mathbf{20}_N$ are to receive screws 22 constituting balance weights. These screws all have the same diameter but they are of different lengths, thus making it possible to have a set of screws with different weights.

The number, the angular positions around the axis of rotation 14 of the fan, and the weights of the screws 22 mounted on the air inlet cone of the fan define a balancing configuration for the fan, which balancing configuration is installed thereon in order to reduce vibration of the low pressure spool of the turbojet while it is in operation.

Such a balancing configuration for the fan is specific to each engine and is prepared at the time the engine is delivered. The way in which this configuration is prepared and then converted into angular positions for balance weights on the fan is well known to the person skilled in the art and is not described in detail herein.

Furthermore, each screw 22 forming a balance weight is associated with an element for identifying its weight. In the embodiment of FIGS. 1 to 3, this weight identification element is the head of the screw 22*a*, which possesses a particular visual characteristic that is previously associated with its weight.

The term "particular visual characteristic" is used herein to mean a characteristic of shape and/or color enabling the screws to be distinguished from one another by the naked eye. As examples of different shapes, the screw heads 22*a* may thus be square, circular, hexagonal, etc. in shape or they may be provided with lines. As examples different colors, the screw heads 22*a* may be painted red, yellow, green, etc. Reference may be made to French patent application No. 12/61830 filed on Dec. 10, 2012 by the Applicant, which describes in detail how such visual identification elements may be provided for the weights of balancing screws.

A correspondence table is established where each screw suitable for use as a balancing weight in the fan is included, being listed with the shape and/or the color of the screw head associated with the weight of the corresponding screw. This correspondence table is stored in a memory of a work computer 24 (FIG. 3).

Furthermore, each hole $\mathbf{20}_1$ to $\mathbf{20}_N$ is associated with an element for identifying its angular position on the air inlet cone 18 of the fan. In the implementation of FIGS. 1 to 3, this element for identifying the angular positions of the holes is a visual mark, in particular a number, placed in the vicinity of each hole $\mathbf{20}_1$-$\mathbf{20}_N$ and previously associated with a determined angular position on the air inlet cone of the fan.

Thus, by way of example, the number 1 is placed in the vicinity of the hole $\mathbf{20}_1$, the number 2 is placed in the vicinity of the hole $\mathbf{20}_2$ that is directly adjacent to the hole $\mathbf{20}_1$ in the clockwise direction, etc. Naturally, other visual marks could be applied for visually identifying the angular positions of the various holes in the air inlet cone of the fan in which the screws forming balance weights are mounted.

Another correspondence table is drawn up in which each visual mark identifying the angular position of a hole in the air inlet cone of the fan is entered together with the corresponding angular positions of the holes on the air inlet cone. This correspondence table is likewise stored in a memory of the work computer 24.

In the invention, the method of identifying the balancing configuration installed in this way on the fan comprises contactless scanning all of the screws 22 mounted on the inlet cone 18 of the fan 10 by means of an identification appliance enabling the identification elements for the weight and for the angular position associated with each screw to be recognized.

This method is automatic in the sense that it does not require operator intervention in order to make the various screws mounted on the inlet cone of the fan correspond with their angular position.

In the implementation shown in FIGS. 1 to 3, the identification appliance is a digital camera 26 associated with image processing software installed in the work computer 24. This camera 26 scans (automatically or with the help of an operator) all of the holes $\mathbf{20}_1$ to $\mathbf{20}_N$ in the air inlet cone of the fan in which the balance weight forming screws 22 are mounted (the camera scans one complete turn of the air inlet cone).

The hole images picked up during this complete scan of the air inlet cone are transmitted to the work computer 24 by any appropriate transfer means in order to be processed therein.

Figure 4:
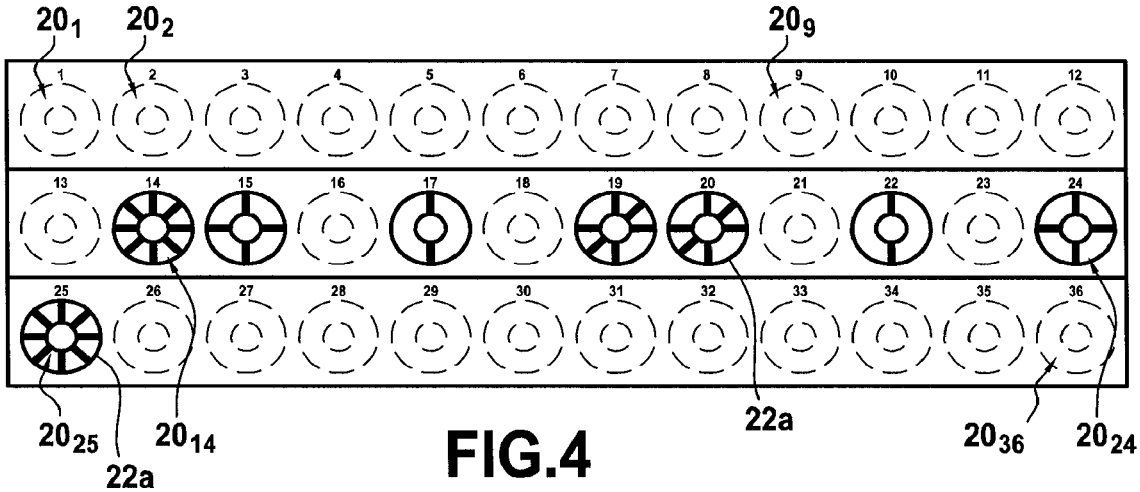
FIG. 4 shows an example of elements for identifying the weights and the angular positions on the fan of the balance weights of FIGS. 1 to 3.

These images are typically like those shown in FIG. 4: in this figure, there can be seen the images of 36 holes $\mathbf{20}_1$ to $\mathbf{20}_{36}$ in an air inlet cone of the fan, together with the images of the heads 22*a* of the screws forming balance weights that are mounted in some of the holes.

The image processing software of the work computer then processes these images, automatically recognizing the numbers 1 to 36 placed in the vicinity of each of the holes $\mathbf{20}_1$ to $\mathbf{20}_{36}$ in the air inlet cone of the fan, together with the various shapes of screw head 22*a*. With the help of the correspondence table stored in its memory, the work computer can then automatically identify the balancing configuration installed on the fan.

The acquisition, transmission, and processing of the images may be performed automatically without the intervention of an operator.

Figure 5:
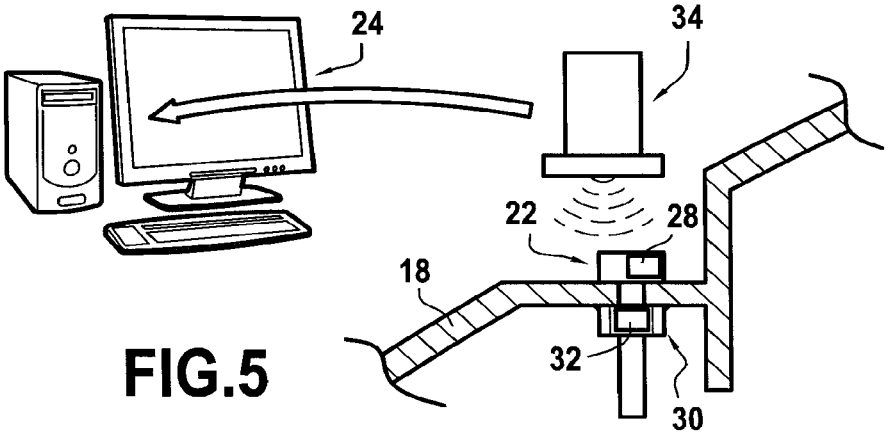
FIG. 5 is a diagrammatic view of a turbojet fan presenting a variant implementation of the invention.

FIG. 5 shows a variant implementation of the method for identifying the balancing configuration installed on the fan of the invention.

In this variant implementation, each balance weight forming screw 22 has an RFID tag 28 with an electronic chip that contains data identifying the weight of the screw.

Furthermore, the balance weight forming screws 22 are mounted in respective ones of the holes $\mathbf{20}_1$ to $\mathbf{20}_N$ of the air inlet cone 18 of the fan by means of corresponding nuts 30, each of these nuts having an RFID tag 32 with an electronic chip containing data identifying the angular position of the corresponding screw on the air inlet cone.

Still in this variant implementation, the method comprises contactless scanning of all of the screws 22 mounted on the air inlet cone of the fan by means of an RFID tag reader 34, which is associated with data processing software installed in the work computer 24.

This RFID tag reader 34 scans (automatically, or with the help of an operator) all of the holes $\mathbf{20}_1$ to $\mathbf{20}_N$ in the air inlet cone of the fan in which the balance weight forming screws 22 are mounted.

During this scan, the RFID tag reader 34 picks up and transmits to the work computer the data relating to the weights of the screws and to the angular positions of the corresponding holes, which data is stored in the electronic chips of the RFID tags associated with each of the screws and with each of the holes in the air inlet cone of the fan. The data processing software can then automatically identify the balancing configuration installed in the fan.

In a variant implementation that is not shown, the system for identifying the balancing configuration installed on the fan is on board the airplane in order to communicate with the avionics system that manages the balancing state of the fan. As a result, such a system knows automatically and continuously the balancing state of the fan of the engine without any need of an operator to inform it.

The invention claimed is:

1. A method of identifying a balancing configuration installed on a turbine engine rotor by:

mounting a plurality of screws forming balance weights on the turbine engine rotor at different angular positions of the turbine engine rotor, each screw of the plurality of screws possessing a predetermined weight, and each screw of the plurality of screws being associated with an element for identifying its weight and another element for identifying its angular position on the turbine engine rotor, and contactless scanning of the plurality of screws mounted on the turbine engine rotor by an identification appliance capable of recognizing the element for identifying the weight and the element for identifying the angular position associated with each screw of the plurality of screws.

2. The method according to claim 1, wherein the identification appliance is a digital camera associated with image processing software.

3. The method according to claim 2, wherein the turbine engine rotor further comprises holes which present an element visually identifying the angular position of each screw mounted therein on the turbine engine rotor, and each screw of the plurality of screws has a screw head comprising a visual characteristic, said visual characteristic associated with the weight of each screw on which each screw head is provided.

4. The method according to claim 3, wherein the element visually identifying the angular position on the turbine engine rotor of each screw is a visual mark applied in a vicinity of each hole in the turbine engine rotor and associated with a determined angular position on the turbine engine rotor.

5. The method according to claim 4, wherein the visual mark applied in the vicinity of each hole of the turbine engine rotor is a number.

6. The method according to claim 3, wherein each visual characteristic of each screw head includes a particular shape and/or color.

7. The method according to claim 1, wherein the identification appliance is an RFID tag reader associated with data processing software.

8. The method according to claim 7, wherein each screw of the plurality of screws is mounted in a hole of the turbine engine rotor by a nut, each screw of the plurality of screws having an RFID tag with an electronic chip containing an element for identifying the weight of each screw on which the RFID tag is provided, and each nut having an RFID tag with an electronic chip containing an element identifying the angular position of each screw on which the RFID tag is provided, on the turbine engine rotor.

9. The method according to claim 1, including a prior step of establishing a table listing each of the elements for identifying the weight and the angular position of each screw.

10. The method according to claim 1, further including automatically storing and transmitting the identified balancing configuration to an avionics system.

11. The method according to claim 4, wherein the visual characteristic of each screw head includes particular shapes and/or colors.

12. The method according to claim 5, wherein the visual characteristic of each screw head includes particular shapes and/or colors.

* * * * *